US008082851B2

(12) United States Patent
Polovnev et al.

(10) Patent No.: US 8,082,851 B2
(45) Date of Patent: Dec. 27, 2011

(54) CAVITATING CORE

(75) Inventors: Andrey Albertovich Polovnev, Moscow (RU); Vladimir Shaymukhametovich Khasiakhmetov, Kharkov (UA)

(73) Assignee: DSG Technology AS, Lorenskog (NO)

( * ) Notice: Subject to any disclaimer, the term of this patent is extended or adjusted under 35 U.S.C. 154(b) by 180 days.

(21) Appl. No.: 12/298,536

(22) PCT Filed: Feb. 12, 2007

(86) PCT No.: PCT/RU2007/000068
§ 371 (c)(1),
(2), (4) Date: Oct. 26, 2008

(87) PCT Pub. No.: WO2007/126330
PCT Pub. Date: Nov. 8, 2007

(65) Prior Publication Data

US 2009/0064888 A1 Mar. 12, 2009

(30) Foreign Application Priority Data

Apr. 27, 2006 (RU) ..... 2006114408

(51) Int. Cl.
*F42B 12/74* (2006.01)

(52) U.S. Cl. ..... 102/519; 102/518

(58) Field of Classification Search ..... 102/519, 102/518
See application file for complete search history.

(56) References Cited

U.S. PATENT DOCUMENTS

| | | | | |
|---|---|---|---|---|
| 4,517,897 | A * | 5/1985 | Kneubuhl | 102/439 |
| 7,765,934 | B2 * | 8/2010 | Spatz et al. | 102/518 |

FOREIGN PATENT DOCUMENTS

| | | | |
|---|---|---|---|
| GB | 9800 | A | 4/1915 |
| RU | 2007690 | C1 | 2/1994 |
| RU | 2045742 | C1 | 10/1995 |
| RU | 2112205 | C1 | 5/1998 |
| RU | 2268455 | C1 | 1/2006 |
| WO | 0049362 | A1 | 8/2000 |

OTHER PUBLICATIONS

Ardachev & Fedoseev pp. 160-177.

(Continued)

*Primary Examiner* — Stephen M Johnson
(74) *Attorney, Agent, or Firm* — John B. Hardaway, III; Nexsen Pruet, LLC

(57) ABSTRACT

The invention relates to ammunition for missile weapon and firearm. The cavitating core of the invention comprises a head part conjugated with a secant nose surface along the cavitating edge, a central part, and an aft part with a gliding surface, wherein the caliber of the core is defined by the maximum diameter of the circle describing the core cross-section. The contour line enveloping the cross-sections from the cavitating edge to the core caliber in the plane of the core axial longitudinal section is limited by the dependence:

$$D_x = d \times /1 + (1_x/d) \times (2 \times \sin \phi/\pi)^{1/N}]^N, \text{ where}$$

$D_x$—is the current diameter of the core enveloping contour R, mm;

d—is the cavitating edge diameter, mm;

$L_x$—is the current distance from the cavitating edge to the core caliber, mm;

$\phi = 60° \ldots 270°$— is the apex angle of the tangents to the secant nose surface at the points of its conjugation with the cavitating edge measured from the side of the head part;

$N = (2\pi/\phi)^{0.4} \ldots (2\pi/\phi)^{0.2}$— is the core volume factor, wherein the core caliber is equal to the current diameter of the core enveloping contour $D_x$.

As a result the invention makes it possible to increase the effective distance for hitting underwater targets when shooting from the air to the water and/or during underwater shooting using arbalests, harpoon guns, artillery, small and sporting-and-hunting weapons.

18 Claims, 3 Drawing Sheets

OTHER PUBLICATIONS

Chikin pp. 272-275.

Gurevich pp. 160-168.

Gurevich pp. 410-460.

Ivanov pp. 38-39.

Yakimov pp. 67-70.

PCT/RU2007/000068 International Search Report (Jul. 19, 2007), 1 page.

* cited by examiner

CAVITATING CORE

FIELD OF THE INVENTION

This invention relates to ammunition for missile weapon and firearm and can be used in the design of harpoon arrows for arbalests and harpoon guns, as well as in the design of bullets for small arms, artillery and sporting-and-hunting guns used for firing under the water, from the air into the water, in the air and from the water into the air. Possibility of shooting in the water is defined for every weapon system individually.

BACKGROUND ART

Wide interest in underwater sports stimulates creation of cavitating cores for sport shooting at underwater marks and for underwater hunting with arbalests, harpoon guns and firearms.

The need in creating cavitating cores arises from the fact that harpoon arrows for arbalests and harpoon guns slow down in the water and quickly stop due to the viscous fluid hydrodynamic drag, and available bullets intended for firing in the air loose their stability after entering the water and come to stop at the range of 0.5-0.7 m.

There is information about 4.5 mm and 5.66 mm ammunitions with a caliber bullet made in the form of a cavitating core with the length of more than 21 calibers. The core travels in the water stably due to the formation of a natural cavity, but is not stabilized for flight in the air (see IVANOV V. N. "ZNIITOCHMASH—razrabotchik patronov"—VPK: Voenny Parad (Military Parade), 01/02 2001, page 38 . . . 39, hereinafter referred as "IVANOV", CHIKIN A. M. "Morskie Diavoly"—Moscow, "Veche" Publishers, 2003, page 272 . . . 275, hereinafter referred as "CHIKIN", ARDASHEV A. N., FEDOSEEV S. L., "Oruzhie spetsialnoe, neobychlloe, exoticheskoe"—Moscow, "Voennaya technika" Publishers, 2001, page 172 . . . 177, hereinafter referred as "ARDASHEV et al.").

To hit targets successfully in the atmosphere and in the aquatic environment cavitating cores must retain their stability while moving both in the air and in the water, as well as must smoothly pass the interface (air-water and water-air).

Stable flight of the cavitating core in the air is provided by its aft part that may have the form of a multiblade empennage at aerodynamic stabilization. And at spin-stabilization it may have a cone-cylindrical form to give gyroscopic stability to the core.

From technical literature it is known that high-speed movement of the cavitating core in the water is accompanied by the formation of a natural cavity, which widens behind the cavitating edge of the core secant nose part. The contour of that cavity is close to the ellipsoid of revolution, its end parts corresponding to the asymptotic law of jet spread and being constant on the most part of the underwater trajectory (see GUREVICH M. I. "Teoria struy idealnoy zhidkosti"—Moscow, Physical-mathematical Literature Publishing, 1961, page 160 . . . 168, 410 . . . 460, hereinafter referred as "GUREVICH", YAKIMOV Yu. L. "Ob integrate energii pri dvizhenii s malymi tchislami kavitatsii I predelnyh formah kaverny"—Academy of Science of the USSR, Fluid and Gas Mechanics, No. 3, 1983, page 67 . . . 70).

It is also well known that the largest cavity diameter $D_\kappa$ depends on the cavitation number σ, cavitating edge diameter d and its cavitating drag index $c_x$:

$$D_\kappa = d \times (C_x/\sigma)^{0.5}$$

The cavitation number σ depends on the hydraulic pressure P and water density ρ, as well as on the water vapor pressure in the cavity ($P_0$~0.02 kg/cm$^2$) and core velocity V:

$$\sigma = 2 \times (P - P_0)/\rho \times V^2$$

The cavity length depends on its largest diameter $D_\kappa$:

$$L_\kappa = D_\kappa \times \sigma^{-0.5} \times (\ln \sigma^{-1} + \ln \ln \sigma^{-1})^{0.5}$$

Initial cavity dimensions are in large excess over the dimensions of the core. For example, the length of cavitating cores of ammunition for sporting and hunting guns is 25 . . . 60 mm, while for the core velocity of 800 m/s the length of the cavity at the depth of 2 m is more than 13 m and for the core velocity of 500 m/s the length of the cavity at the depth of 2 m is more than 5 m. The length of end parts of the cavity (forward and rear sections) makes up 10% of its total length; their contour is constant and corresponds to the asymptotic law of jet spread.

Stabilization of the core in the cavity is provided by its aft part due to one-sided periodic washing and gliding along the cavity contour with its gliding surface; therefore the largest diameter of the circle that circumscribing the cross-section of the aft part defines the cavitating core caliber.

Scattering on the underwater trajectory depends on the geometry of the core head part, which is affected by water particles that escape from cavitating edge and also on the depth and the area of inertial washing of the core aft part gliding surface that defines the value of the one-sided gliding drag.

When the central or the head part is washed in the cavity, the core loses its stability, tumbles and slows down by the lateral surface.

Moving in the cavity, the core loses its energy to overcome the cavitation drag F:

$$F = c_x \times \pi \times d^2 \times \rho \times V^2/8$$

The core velocity V on the underwater distance S depends on its mass m, initial velocity $V_0$ and cavitation drag F:

$$V = V_0 \times e^{-s \times F/m}$$

With the drop of the core velocity V the cavitation number σ grows and the cavity dimensions $L_\kappa$ and $D_\kappa$ reduce; moreover, with the depth increase the dimensions reduction and the cavity collapse on the core aft part occur earlier, at a higher velocity V and at a shorter distance S.

In the course of the cavity collapse, besides the cavitation drag F, there also appears the fluid viscous drag on the core surface that significantly increases the total hydrodynamic resistance.

In accordance with hydrodynamics laws the range of targets hitting under the water could be increased by raising the core mass m, as well as by reducing the cavitating edge diameter d and the index of its cavitation drag $c_x$. For these purposes the cavitating core contour must correspond to the contour of the cavity forward part, which has a constant volume along the most part of the underwater trajectory.

A cavitating core intended for firing from special weapon is known firm publications (see Description to patent RU 2112205, Int. Cl.$^6$ F42B 30/02, published May 27, 1998). The head part of the core with a flat secant nose surface has the form of a truncated cone; central and aft parts are cylindrical and correspond to the weapon caliber. For stabilization in the air the core head part is made of tungsten alloy and the central part and aft part with tail empennage of aluminum. The contour of this core corresponds to the geometry of known cavitating cores for 4.5 mm ammunition (see IVANOV, CHIKIN ARDASHEV et al.), therefore under the water the core is stabilized in the formed cavity.

The disadvantage of that cavitating core with the length of more than 21 calibers lies in its geometry, as for its correspondence to the cavity contour, the cavitating edge diameter should be increased; that results in the formation of a cavity with an oversized volume, and an extended gap between the gliding surface and the cavity contour promotes significant angular oscillations and deep inertial washing of narrow blades of the tail empennage. The above mentioned disadvantages result in the growth of scattering along the underwater trajectory and in the reduction of underwater targets hitting range.

There is information about a cavitating core intended for firing from firearms with the use of a discarding sabot. In this core the conical head part with a cylindrical section is conjugated with the flat secant nose surface along the cavitating edge. The central cylindrical part has circular grooves for fixation in the discarding sabot, and the aft part is made in the form of a multiblade empennage with triangular fins having a sharp edge on the gliding surface (See Description to U.S. Pat. No. 5,955,698, Int. Cl.[6] F42B 15/20, published on Sep. 9, 1999).

The disadvantage of this known design lies in the fact that the cavitating core contour is significantly understated relative to the cavity contour; that reduces the mass and strength of the core. A sharp edge on the gliding surface of empennage blades is subjected to deep washing due to its small area, and that results in the increased gliding drag. The gap between the core and the cavity contour at the base of the core head part is substantially reduced, so water particles that escape from the cavitating edge exert additional impact on the head part. The above mentioned disadvantages result in the growth of scattering along the underwater trajectory and in the reduction of underwater targets hitting range.

The closest analog (prototype) of this claimed invention is a cavitating core intended for shooting from firearms with the use of a discarding sabot. The cavitating core has a head part conjugated with a secant nose surface along the cavitating edge, a central part and an aft part with a gliding surface; the caliber of the cavitating core is defined by the maximum diameter of the circle circumscribing the aft part cross-section. In the plane of the core axial longitudinal section the apex angle of tangents to the secant nose surface in the points of its conjugation with the head part is 60°-18°, and the enveloping contour of the core cross-sections is confined by the outline of three conjugated truncated cones inscribed into the contour of the cavity formed. Stabilization of the cavitating core in the air may be provided by rotation or by the aft empennage (See Description to patent RU 2268455, Int. Cl.[7] F42B 10/38, published on Jan. 1, 2006).

The disadvantage of this known design lies in the fact that the contour of three conjugated truncated cones cannot correspond to the cavity outline exact approximation, so the cavitating core geometry is not optimal, and the cavitating core mass is always understated, hence underwater targets hitting range is also reduced. Besides, this cavitating core design cannot be used without a discarding sabot for shooting from arbalests and harpoon gulls, as well as from firearms.

SUMMARY OF THE INVENTION

The purpose of the given invention is to increase the effectiveness of underwater targets hitting in the course of firing from firearms and missile weapons in the air and in the water.

Technical result—is the creation of a cavitating core with the contour close to the contour of the forward end of the cavity.

The mentioned technical result is achieved in the following way: in the cavitating core comprising a head part, conjugated with a secant nose surface along the cavitating edge, a central part, and an aft part with a gliding surface, wherein the caliber of the core is defined by the maximum diameter of the circle circumscribing the aft part cross-section, according to this invention, the contour line enveloping the cross-sections from the cavitating edge to the core caliber in the plane of the core axial longitudinal section is limited by the dependence:

$$D_x = d \times [1 + (L_x/d) \times (2 \times \sin \phi/\pi)^{1/N}]^N, \text{ where}$$

$D_x$—is the current diameter of the core enveloping contour R, mm;

d—is the cavitating edge diameter, mm;

$L_x$—is the current distance from the cavitating edge to the core caliber, mm;

$\phi$=60° . . . 270°—is the apex angle of the tangents to the secant nose surface at the points of its conjugation with the cavitating edge measured from the side of the head part;

$N=(2\pi/\phi)^{0.4}$ . . . $(2\pi/\phi)^{0.2}$—is the core volume factor, wherein the core caliber is equal to the current diameter of the core enveloping contour $D_x$.

The nose surface of the cavitating core may have the form of a quadric surface e.g. a spherical segment or a paraboloid of revolution, or the form of a cone aperture.

The head part of the core may have a narrow circular groove, its minimal diameter equal to 1.1-1.7 of the cavitating edge diameter.

In the plane of the core axial longitudinal section the tilt angle of the gliding surface in the direction of the head part measured relative to the core longitudinal axis may be 1°-2.5°.

Moreover, in the plane the core axial longitudinal section the tilt angle of the gliding surface in the direction of the core bottom end surface measured relative to the core longitudinal axis may be 1°-2.5°.

Moreover, the aft part with a gliding surface may be made in the form of multiblade empennage.

Moreover, the aft part with a gliding surface may be made in the form of multiblade empennage having a cylindrical bottom section.

Moreover, the aft part with a gliding surface may be made of material with a less density relative to the head and central part, may be made in the form of multiblade empennage and may be installed with the capability of rotation relative to the cavitating core longitudinal axis.

Moreover, the cavitating core may be made of easily deformable material.

Moreover, the cavitating core may be made of easily deformable material with inner filling of high-density material.

Moreover, the central and aft parts may be made of material with a less density and strength relative to the core head part and the head part may be equipped with a high-strength element in the form of a rod or a casing.

The presented system of invention features allows us, within overall dimensions of conventional ammunition, to design cavitating cores having an increased range of underwater targets hitting in the course of firing in the air and in the water due to an optimal matching to the cavity contour, a reduced cavitation drag and scattering along the underwater section of trajectory.

Dimensions of cavitating cores for the core length up to 6 calibers allow achieving spin-stabilization in the air and for the core length more than 6 calibers—to stabilize it with tail empennage.

The authors of the presented invention have determined that in the range of cavitating cores practical application for values of the cavitation number $\sigma=0.002 \ldots 0.1$ the cavitation drag index $c_x$ does not depend on the form of the nose surface central part, which may be rounded or furnished with a conical aperture, but depends on the apex angle $\phi$ of tangents in the points of conjugation with the cavitating edge, and is defined by the formula:

$$c_x=\sin \phi/\pi$$

Besides it differs by 2 to 7% from the index $c_x$ for conical surfaces, presented in the GUREVICH's work on the page 443.

To decrease specific loading on the cavitating core nose surface the angle $\phi$ must differ from 180°; that allows using cavitating cores not only of tungsten alloy or of steel, but also of easily deformable materials such as nonferrous metal alloys. However, when the angle $\phi$ is more than 270°, the strength of the cavitating edge decreases and for the angle $\phi$ less than 60°, the fact of the cavity formation becomes unreliable.

For a stable cavitating motion the cavitating core must correspond to the cavity in such a manner that when it touches the cavity contour by its gliding surface, the gap remains on a proper level in its head and central parts and smoothly decreases in the bottom part. To fulfill these requirements, the cavitating core caliber D must be equal to the current diameter $D_x$ of the enveloping contour R. The diameter of the rest core cross-sections, from the cavitating edge to the caliber D located at the distance L, must not oversize the enveloping contour R. Overstating of the contour R results in the washing of the cavitating core surface that projects from the enveloping contour R and in the loss of stabilization when it moves in the cavity. Understating of the enveloping contour R results in the decrease of the cavitating core mass, but may be compensated by its length, e.g. in the design of the core with tail empennage. In the optimal embodiment the cavitating core contour must coincide with the contour R, and all structural elements such as circular grooves, threads and longitudinal slots must be confined by the contour R.

The cavitating core contour R, as well as the cavity outline depends on the cavitating edge diameter d and on the cavitating drag index $c_x$ expressed in the terms of the angle $\phi$. Cores with different volume factor N, which must be in the range of $(2\pi/\phi)^{0.4}$ to $(2\pi/\phi)^{0.2}$, may be adjusted to the cavity contour. When this volume factor N is understated, the cavitating core strength decreases; when the volume factor N is overstated, the current diameter D, of the cavitating core exceeds the current diameter of the cavity.

The area of the gliding surface is determined in accordance with inertial parameters of the core. The understated gliding area increases the depth of inertial washing, while the overstated gliding area increases the gliding drag, both resulting in the growth of scattering along the underwater section of trajectory.

Cavitating core dimensions according to the invention are limited by the dimensions of ammunition; e.g. the length of harpoons for spring or pneumatic harpoon guns can make up more than 1.2 m.

The abovementioned dependences that could be used for calculating a core with the length from three to one hundred sixty calibers were achieved in the course of calculations and then verified practically during shooting from harpoon guns, arbalests and firearms.

BRIEF DESCRIPTIONS OF THE DRAWINGS

The invention is explained in more detail on actual examples that in no way cut down the volume of claims and are only intended for a better understanding of the invention gist by experts. In the description of concrete examples of the invention embodiments there are reference to the accompanying drawings that show:

FIG. 1 is a schematic view of a cavitating core located in the cavity for ammunition caliber 0.308 (0.308 inch=7.62 mm) intended for firing with a discarding sabot from rifles.

DETAILED DESCRIPTION OF THE PREFERRED EMBODIMENT

Figure 1:
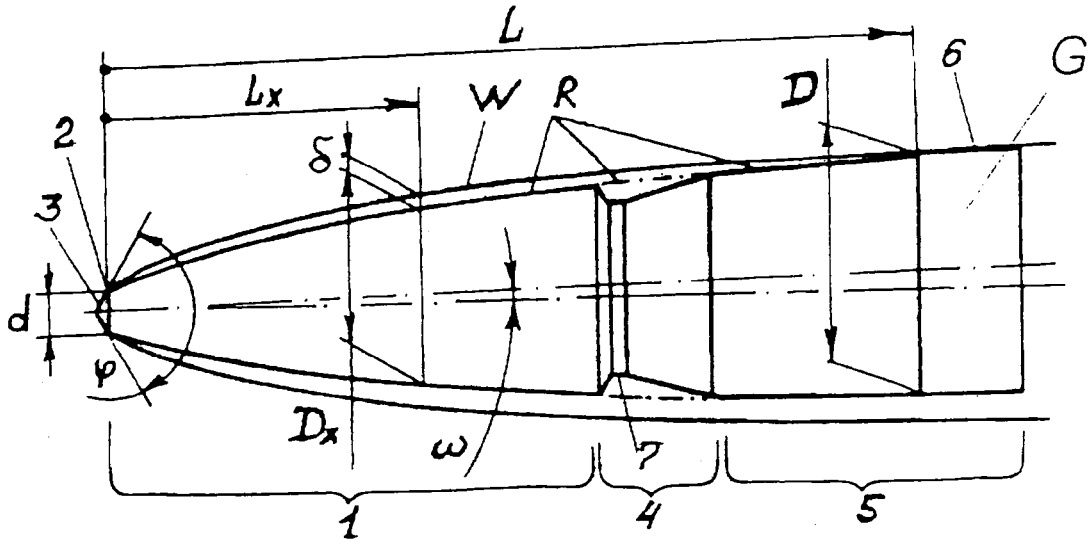
FIG. 1, FIG. 2, FIG. 3 and FIG. 4 are the first, second, third and fourth examples of cavitating core embodiments according to this invention located in the cavity.

The cavitating core G consists of a head part 1 conjugated along the cavitating edge 2 having the diameter d with a secant nose surface 3, a central part 4, and an aft part 5 with a cylindrical gliding surface 6. The core caliber D is less than the barrel bore inner diameter measured at rifling fields. To prevent deformation of the conical nose surface 3 its top is rounded. For fixation in a discarding sabot the central part 4 has a groove 7.

The current diameter $D_x$ of the cavitating core enveloping contour on the current length $L_x$ from the cavitating edge 2 to the caliber D on the length L (excluding groove 7) coincides with the enveloping contour R that corresponds to the function:

$D_x=d\times[1+(L_x/d)\times(2\times\sin \phi/\pi)^{1/N}]^N$, where: d=1.75 mm, $\phi=90°$, N=0.50.

The cavitating core contour R and the cavity contour W match in such a way that in the cavity the core rotary angle $\omega$ makes up less than 1.8°, and between the contour W and the core contour R there retains a gap $\delta$ of less than 0.5 mm smoothly decreasing to the gliding surface 6.

The cavitating core may be made of steel or easily deformable material, e.g. of nonferrous metal alloys (bronze, brass), and in order to increase its mass it may be filled with lead or other high-density alloy, or may be completely made of tungsten alloy. The core is spin-stabilized in the air and its length is 1.5 D.

Figure 2:
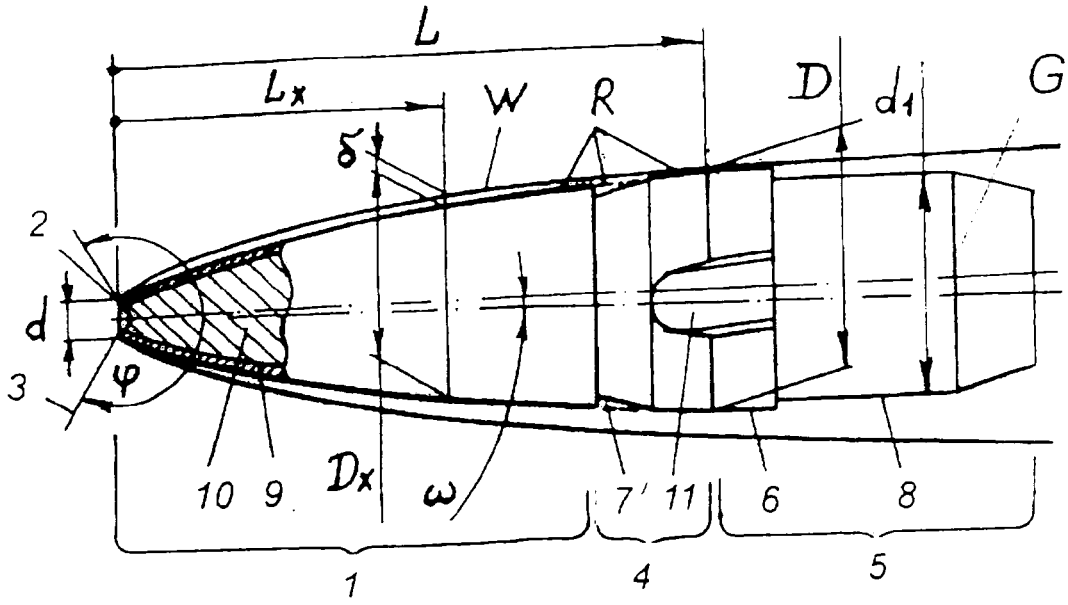

FIG. 2 is a schematic view of the cavitating core located in the cavity for ammunition caliber 0.308 intended for firing without a discarding sabot from rifles.

The cavitating core G consists of a head part 1, conjugated along the cavitating edge 2 having the diameter d with the secant nose surface 3 made in the form of a conical aperture, a central part 4 and an aft part 5 with a cylindrical gliding surface 6, equal to the cavitating core caliber D and the surface 8. To fix the cavitating core in the discarding sabot the central part 4 has a groove 7.

The cavitating core is manufactured in the form of a casing 9 made of easily deformed nonferrous metal alloy and filled with lead 10. The diameter $d_1$ of the surface 8 corresponds to the barrel bore inner diameter measured at rifling fields. The cavitating core caliber D corresponds to the outer diameter of a standard bullet caliber 0.308 and is bigger than the diameter $d_1$. During the pass through the barrel bore on the gliding surface 6 traces 11 from rifling grooves appear.

The current diameter $D_x$ of the cavitating core enveloping contour on the current length $L_x$ from the cavitating edge 2 to the caliber D on the length L (excluding groove 7) coincides with the enveloping contour R that corresponds to the function:

$$D_x=d\times[1+(L_x/d)\times(2\times\sin\phi/\pi)^{1/N}]^N,\text{ where: } d=1.6\text{ mm},\ \phi=240°,\ N=0.35.$$

The cavitating core contour R and the cavity contour W match in such a way that in the cavity the core rotary angle ω makes up less than 1.6°, and between the contour W and the core there retains a gap δ of less than 0.45 mm that smoothly decreases to the gliding surface 6. In the cavity the core glides with its profile surface 6 having traces 11 from rifling grooves, while the surface 8 does not touch the cavity contour W. In the air the cavitating core is spin-stabilized and its length is 4.8 D.

Figure 3:
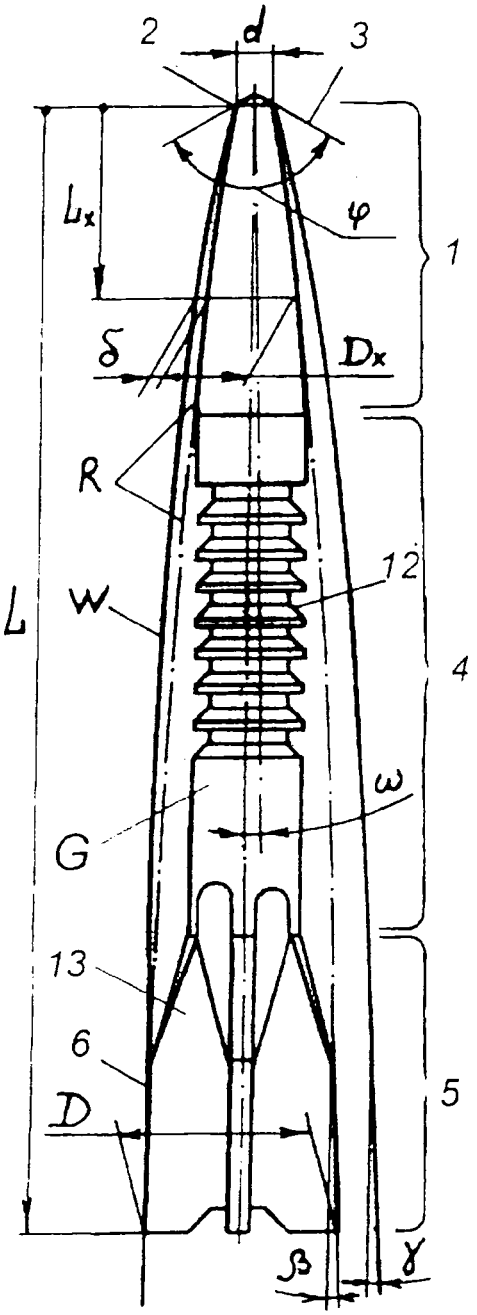

FIG. 3 is a schematic view of the cavitating core located in the cavity for ammunition caliber 0.410 (0.410 inch=10.3 mm), intended for firing with a discarding sabot from smoothbore guns.

The cavitating core G consists of a head part 1, conjugated along the cavitating edge 2, having the diameter d, with a secant nose surface 3, a central part 4 and an aft part 5 with a gliding surface 6. The aft part 5 is made in the form of tail empennage 13. For fixation in the discarding sabot the central part 4 has circular grooves 12. The maximum diameter of the circle circumscribing the aft part 5 cross-section is equal to the cavitating core caliber D and is less than the barrel bore inner diameter.

The current diameter $D_x$ of the cavitating core enveloping contour on the current length $L_x$ from the cavitating edge 2 to the caliber D on the length L (excluding the central part 4 and the forward edge of multiblade empennage 13 on the aft part 5) coincides with the enveloping contour R, which corresponds to the function:

$$D_x=d\times[1+(L_x/d)\times(2\times\sin\phi/\pi)^{1/N}]^N,\text{ where: } d=1.7\text{ mm},\ \phi=120°,\ N=0.44.$$

The cavitating core contour R and the cavity contour W match in such a way that in the cavity the core rotary angle ω makes up less than 1.4°, and between the contour W and the head part 1 there retains a gap δ less than 0.45 mm that increases in the central part 4 and smoothly decreases to the gliding surface 6.

The gliding edge of multiblade empennage coincides with the contour R and is inclined relative to the cavitating core axis. That makes it possible to provide exact coincidence of the gliding surface 6 and the cavity contour W taking into consideration the angle γ of the cavity contour W and the cavitating core rotary angle ω, to reduce the washing depth of empennage blades 13, and to decrease scattering in the water.

The gliding surface 6 may be inscribed into the calculated contour R. E.g. in this example the tilt angle β of the gliding surface 6 in the direction of the head part 1 measured relative to the core longitudinal axis may be 1.9°, that allows us to provide an approximate coincidence of the gliding surface 6 and the cavity contour W and to reduce the washing depth of empennage blades 13 and decrease scattering in the water.

The cavitating core may be made of nonferrous metal alloys or of steel, and to increase the mass its head and central parts may be filled with lead or heavy tungsten alloy. Moreover, the head part may be equipped with a high-strength element in the form of a rod or a casing that allows multiple usage of the cavitating core, e.g. for firing in an underwater shooting gallery (see Description to patent RU 49970 for utility model, Int. Cl.[7] F 41 J 1/18, published on Dec. 10, 2005). The cavitating core length is limited by the length of the ammunition 0.410 Magnum and makes up 6.1 D. During the flight in the air the cavitating core is stabilized by empennage 13.

When using rifles it would be preferable to manufacture the cavitating core empennage of material with less density than its head and central parts and to install it with the capability of rotation about the core longitudinal axis. That prevents rotation of empennage together with the rotating core, increases aerodynamic stability in the air and reduces scattering in the water.

Figure 4:
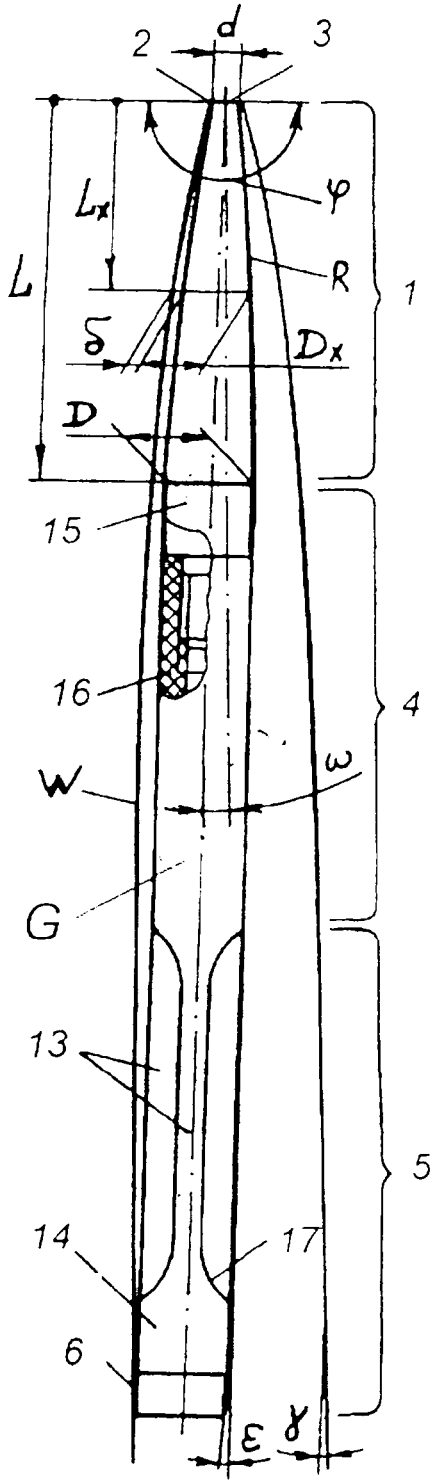

FIG. 4 is a schematic view of the cavitating core located in the cavity for ammunition caliber 5.66 mm intended for firing without a discarding sabot, e.g. from the 5.66 mm underwater submachine-gun APS.

The cavitating core G consists of a head part 1, conjugated along the cavitating edge 2, having the diameter d, with a secant nose surface 3, a central part 4 and an aft part 5 with a cylindrical gliding surface 6. The diameter of the head part base is equal to the cavitating core caliber D and is also equal to the diameter of the central and aft parts, and corresponds to the weapon caliber. In the aft part 5 there is multiblade empennage 13 having a cylindrical bottom section, which in this design is intended for fixing the cavitating core in the cartridge case. The cavitating core length is equal to the length of a standard core for the 5.66 mm ammunition and makes up 21.4 D.

The current diameter $D_x$ of the enveloping contour of the cavitating core head part 1 on the current length $L_x$ from the cavitating edge 2 to the caliber D on the length L coincides with the enveloping contour R, which corresponds to the function:

$$D_x=d\times[1+(L_x/d)\times(2\times\sin\phi/\pi)^{1/N}]^N,\text{ where: } d=1.3\text{ mm},\ \phi=180°,\ N=0.27.$$

The cavitating core contour R and the cavity contour W match in such a way that in the cavity the core rotary angle ω makes up less than 2.6°, and between the contour W and the head part 1 there retains a gap δ of less than 0.55 mm that increases in the central part 4 and smoothly decreases to the gliding surface 6. The tilt angle of the gliding surface 6 in the direction of the core bottom section measured relative to the core longitudinal axis makes up 1.5°, and is determined according to the angle γ of the cavity contour W in the gliding area of the core and to the core rotary angle ω in the cavity. At the same time, coincidence of the gliding surface 6 and the cavity contour W is provided, which allows the reduction of the gliding surface 6 washing depth and the decrease of scattering in the water.

During the flight in the air the cavitating core is stabilized by multiblade empennage 13. To increase stability the centre of the cavitating core mass is shifted to the head part 1 due to the usage of a heavy tungsten alloy nosepiece 15 and of a lighter steel body 16. Besides the aft surface 17 of multiblade empennage 13 and the cylindrical bottom section 14 increase the aerodynamic drag and raise the stability of the cavitating core during its flight in the air.

Designs of cavitating cores for arbalests and harpoon guns correspond to the cavitating core shown in FIG. 4, but differ in length and core material. For multiple usages the head part 1 may be equipped with a high-strength element in the form of a rod or a casing; moreover, the nosepiece 15 may be made of hardened tungsten alloy or steel. To increase stability during the flight in the air and traveling in the water the body 16 having a central and an aft part may be made of material with a lower density, e.g. plastics or aluminum alloy.

Standard arrows for arbalests and harpoons for harpoon guns have a low initial velocity, but a relatively overstated mass. In this case it is possible to increase the underwater range of aimed shooting by increasing the cavitating core initial velocity due to the decrease of its mass. The shift of the center of the cavitating core mass to the head part provides its stable movement after the cavity collapse and circular washing of the body 16 up to the nosepiece 15 is in the cavity.

Figure 5:
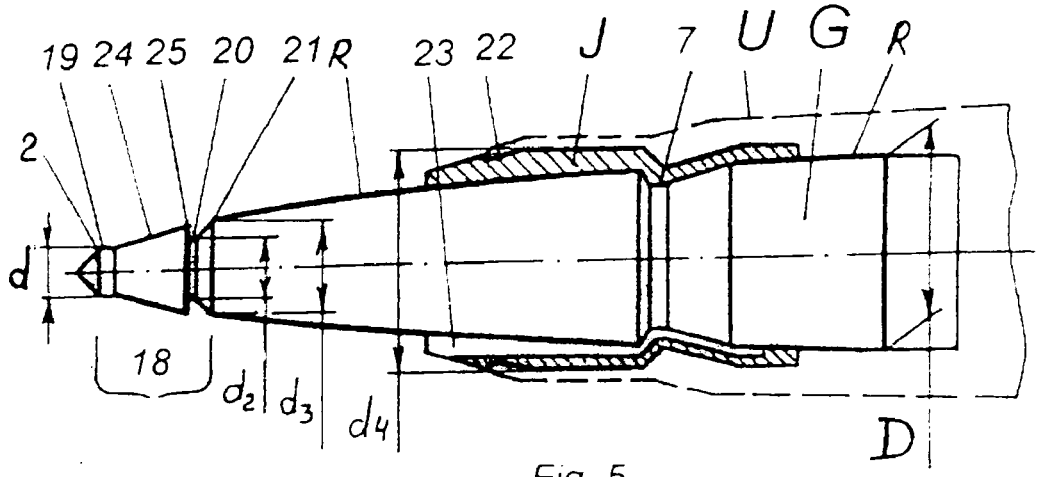
FIG. 5, FIG. 6 and FIG. 7 are the first, second and third examples of cavitating core embodiments according to this invention located in ammunition.

FIG. 5 is a schematic view of the ammunition 0.308 Winchester fragment for sporting-and-hunting weapons containing a cavitating core G, a discarding sabot J and a standard cartridge case U with a primer and a gunpowder charge.

The cavitating core G from the cavitating edge 2 to the caliber D corresponds to the core from FIG. 1 except the geometry of the head part 1 on the length 18. The core contour on the length 18 is less than the contour R due to the cylindrical surface 19 of the head part and to the groove 20 of the head part having the diameter $d_2$, that are equal to 1.1-1.7 of the cavitating edge diameter d; besides the diameter $d_3$ of the edge 21 is equal to the current diameter $D_x$.

The discarding sabot J is rigidly fixed along the groove 7 on the cavitating core G and is pressed into the cartridge case U, which is squeezed into the groove 22. The outer diameter $d_4$ of the discarding sabot J fits the outer diameter of a standard bullet 0.308, therefore when travelling through the barrel the sabot J is squeezed in the rifling and gains angular velocity of transverse rotation together with the core G. After the discharge from the barrel bore the sabot J due to centrifugal force splits up into segments along the longitudinal slots 23 and comes apart from the cavitating core G.

The surface 19 is intended to control the diameter d of the cavitating edge 2. The groove 20 on the head part 1 enables firing into the water at a small angle relative to the water surface and increases the damaging capability of the cavitating core. For example, when the cavitating core comes up to the water surface and the surface 24 is washed, the groove 20 with its edge 25 creates temporary cavitating void under the core and prevents washing of the rest of its surface. After submergence of the core the cavity is formed by the cavitating edge 2 with the diameter d.

The cavitating core made of easily deformable material after penetrating into an unprotected target is deformed with a bend along the diameter $d_2$ of the groove 20 and then turns over thus increasing the damaged area. However, if the diameter $d_2$ is less than 1.1 d the core may be deformed already during underwater motion and lose its stability in the cavity.

The cavitating core made of firm material after colliding with a hard obstacle at a small angle spalls along the diameter $d_2$ of the groove 20, and then the edge 21 with the diameter $d_3$ interacts with the obstacle, that diameter exceeding the diameter d of the cavitating edge 2 by 2-3 times, which is enough to prevent ricochet during the obstacle piercing. But when the diameter $d_2$ is more than 1.7 d, the core may spall along the groove 20.

Figure 6:
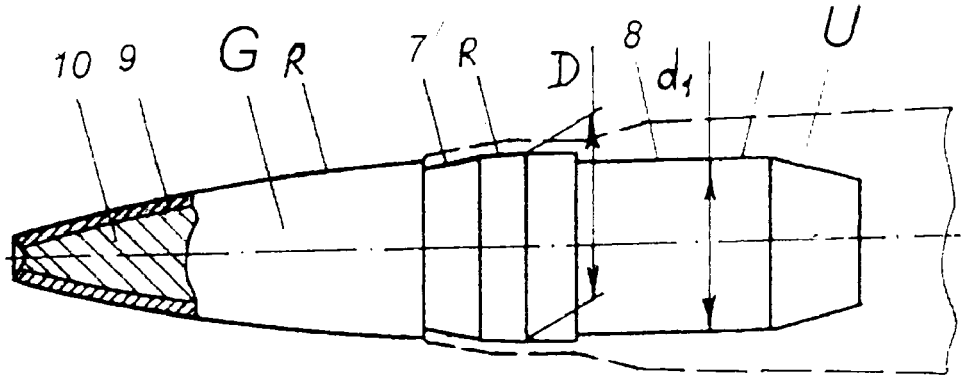

FIG. 6 shows a fragment of 0.308 Winchester ammunition for sporting-and-hunting rifle that consists of a cavitating core G and a standard cartridge case U with a primer, and a gunpowder charge.

The cavitating core G corresponds to the cavitating core shown in FIG. 2, but if necessary it may be made completely of easily deformable material, e.g. brass or bronze, and may have a groove 20 and/or a surface 19 shown in FIG. 5. If the cavitating core G consists of a casing 9 and is filled with lead 10, after hitting the target it is deformed thus increasing the damaged area.

The cavitating core G is pressed along its gliding surface, having the diameter D, into a cartridge case U, which is squeezed into a groove 7. During the shot the diameter D takes the shape of the rifling in the barrel bore, and the surface 8 having the diameter $d_1$ slides along rifling fields. In the cavity the core glides with its profile surface having rifling traces, and surface 8 does not touch the cavity contour.

Figure 7:
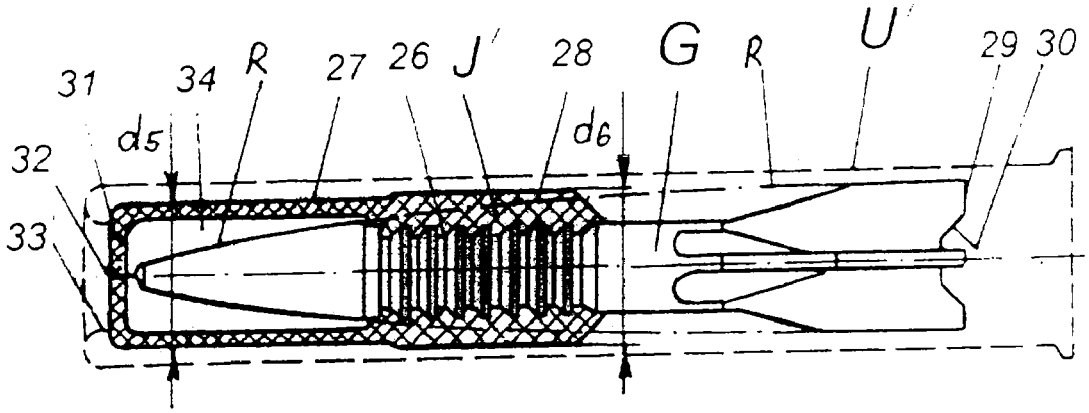

FIG. 7 shows ammunition 0.410 Magnum for smooth-bore sporting-and-lhunting guns, which consists of a cavitating core G, a discarding sabot J and a standard cartridge case U with a primer and a gunpowder charge.

The cavitating core G corresponds to the cavitating core shown in FIG. 3, and the enveloping contour of its cross-sections is confined by the contour R. If necessary, the cavitating core may have a groove 20 and a surface 19 shown in FIG. 5.

The cavitating core is fixed over its circular grooves 26 in a two-sectional split discarding sabot J', where the diameter $d_5$ of the outer surface 27 fits the barrel bore caliber, and the diameter $d_6$ of the outer surface 28 exceeds the barrel bore caliber. In ammunition the cavitating core G is installed into a cartridge case U' bottom up to the stop of the end surface 29. For a better inflammation of the gunpowder charge the rear edge of multiblade empennage 30 is made inclined. For encapsulation of the gunpowder charge the front wall 31 of the sabot is sealed along the line of split 32 and along the contour of rolling 33 on a plastic cartridge case U'.

In the course of shooting the surface 27 having the diameter $d_5$ slides down the barrel bore and the surface 28 having the diameter $d_6$ provides obturation of gunpowder gas. Gunpowder gas partly penetrates into the enclosure 34 and contributes to splitting of the sabot J and its separation from the core G after leaving the barrel bore.

From experiments it is known that when firing at angles more than 7° relative to the horizon, and for rough water—more than 3° relative to the horizon, the cavitating core passes into the water without ricochet and retains its trajectory.

When firing under the water from small-bore fire-arms, extrusion of the water out of the bore is provided by gunpowder gas; the initial velocity of the core is about 15% lower than when firing in the air, and discarding of the sabot from the core takes place in a gas bubble at the distance of 0.3-0.5 m from the muzzle.

Other things being equal, the mass of cavitating cores according to the invention exceeds by 10-15% the mass of cavitating cores specified in the Description to patent RU 2268455, Int. Cl.[7] F42B 10/38, published on Jan. 20, 2000, and in the course of comparative tests with firing from the air into the water and under the water for cavitating cores according to the invention, not only the increase of penetrating capability was revealed, but also the reduction of scattering on the underwater section of trajectory.

INDUSTRIAL APPLICABILITY

Cavitating cores according to the invention may be used for underwater hunting, defense from predators' attack and for sporting shooting from harpoon guns, arbalests, sporting-and-hunting guns and small arms. Expediency of firing in the water is determined for every type of weapons individually.

Ammunition with cavitating cores for small arms may be part of ammunition allowance for combat swimmers, marines, coastguards, crews of ships and naval aircrafts.

Large-caliber ammunition with cavitating cores can be used for self-defense of sea and coastal objectives from underwater, surface and air offensive means in the course of firing in the air from standard machine-guns and guns of motor boats and helicopters, as well as from coastal and ship-based artillery systems.

The invention can be used in the design of rocket weapon intended for air flight and/or cavitating motion in the water.

We claim:

1. A cavitating projectile, which comprises a head part conjugated with a secant nose surface along a cavitating edge, central part, and an aft part with a gliding surface, wherein a caliber of the projectile is defined by a maximum diameter of a circle describing a cross-section of the projectile, cross-section has a contour line enveloping said cross-section extending from the cavitating edge to the maximum diameter of a circle describing a cross-section of the projectile in a plane of an axial longitudinal section of the projectile is limited by the formula:

$$D_x=d\times[1+(L_x/d)\times(2\times\sin\phi/\pi)^{1/N}]^N,$$

where $D_x$ is a diameter of the core line enveloping the cavitating edge;

d is a diameter of the cavitating edge;

$L_x$ is a distance from the cavitating edge to the maximum diameter of a circle describing a cross-section of the projectile;

$\phi$ is an apex angle of tangents to the secant nose surface at points of conjugation of the secent nose surface with the cavitating edge measured from a side of the head part and $\phi$ is at least 60° to no more than 270°;

N=is a core volume factor, wherein the caliber is equal to $D_x$.

2. The cavitating projectile according to claim 1, wherein the secant nose surface comprises a quadric surface.

3. The cavitating projectile according to claim 2, wherein the quadric surface has the form of a conical aperture surface.

4. The cavitating projectile according to claim 1, wherein the head part has a narrow circular groove having minimal diameter of at least 1.1 to no more than 1.7 times the diameter of the cavitating edge.

5. The cavitating projectile according to claim 1, wherein in the longitudinal section the angle of the gliding surface tilt in the direction of the head part measured relative to the core longitudinal axis is 1°-2.5°.

6. The cavitating projectile according to claim 1, wherein a plane containing the axial longitudinal section has a tilt angle relative to a gliding surface in the direction of the core bottom end surface measured relative to the longitudinal axis which is 1°-2.5°.

7. The cavitating projectile according to claim 1, wherein an aft part with a gliding surface comprises a multiblade empennage.

8. The cavitating projectile according to claim 7, wherein the aft part has a cylindrical bottom section.

9. The cavitating projectile according to claim 1, wherein an aft part with a gliding surface is made of a material with a lower density than a density of the head part and a central part, wherein the aft part comprises a multiblade empennage and is installed with a capability of rotation relative to the longitudinal axis of the projectile.

10. The cavitating projectile according to claim 1, wherein the projectile is made of easily deformable material.

11. The cavitating projectile according to claim 10, wherein the projectile is made of easily deformable material having an inner filling of high-density material.

12. The cavitating projectile according to claim 1, wherein a central part and an aft part are made of material with a lower density and strength than a density and strength of the head part.

13. The cavitating projectile according to claim 1, wherein the head part comprises a high-strength element in a form of a rod or a casing.

14. The cavitating projectile of claim 1, wherein the projectile is made of nonferrous metal alloys.

15. A cavitating projectile comprising:

a head part conjugated with a secant nose surface forming a cavitating edge of a set diameter d, a central part and an aft part with a gliding surface, wherein the maximum diameter of a circle circumscribing a cross-section of the projectile is a core caliber D, wherein in a plane of a projectile axial longitudinal section a diameter of core secant sections from the cavitating edge to the circle circumscribing the cross-section of the projectile is not more than $D_x$, wherein:

$$D_x=d\times[1+(L_x/d)\times(2\times\sin\phi/\pi)^{1/N}]^N, \text{ where:}$$

Dx is the diameter of the cross-section of the enveloping contour;

d is a diameter of the cavitating edge, formed by conjugation of the nose surface with the head part of the projectile;

$L_x$ is the distance measured from the cavitating edge to the position of cross-section of the enveloping contour;

$\phi$ is the apex angle of tangents to the secant nose surface at points of its conjugation with the cavitating edge measured from the side of a head part and wherein $\phi$ is at least 60° to no more than 270°;

N is a core volume factor wherein N is at least $(2\pi/\phi)^{0.4}$ to no more than $(2\pi/\phi)^{0.2}$, whereas the core caliber D is equal to the diameter $D_x$ of the cross-section of the enveloping contour when $L_x$=L, where L is a distance from the cavitating edge of the diameter d to the maximum diameter of the cross-section that is equal to the core caliber.

16. The cavitating projectile of claim 15, wherein its nose part has the form of a second order surface which may be a spherical segment or a paraboloid of revolution.

17. The cavitating projectile of claim 16, wherein the projection is made of non-ferrous alloys.

18. The cavitating projectile of claim 17 wherein said projectile is made of bronze or brass.

* * * * *